US007625235B2

(12) United States Patent
Wu et al.

(10) Patent No.: US 7,625,235 B2
(45) Date of Patent: Dec. 1, 2009

(54) ELECTRICAL CONNECTOR WITH A SHIELDING SHELL HAVING SOLDERING TAILS

(75) Inventors: Zhe-Feng Wu, Kunshan (CN); Fa-Xiang Qin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,687

(22) Filed: Sep. 30, 2008

(65) Prior Publication Data

US 2009/0130870 A1 May 21, 2009

(30) Foreign Application Priority Data

Nov. 21, 2007 (CN) ..... 2007 2 0042398 U

(51) Int. Cl.
*H01R 13/648* (2006.01)

(52) U.S. Cl. ..... 439/607.35

(58) Field of Classification Search ..... 439/607.35, 439/609

See application file for complete search history.

(56) References Cited

U.S. PATENT DOCUMENTS

| | | | | |
|---|---|---|---|---|
| 6,319,026 | B1 | 11/2001 | Chen | |
| 6,986,681 | B2 * | 1/2006 | Tsai | 439/607.36 |
| 7,182,641 | B2 * | 2/2007 | Shimoyama | 439/607.35 |
| 7,445,469 | B2 * | 11/2008 | Wu | 439/79 |

FOREIGN PATENT DOCUMENTS

| | | |
|---|---|---|
| TW | M312096 | 5/2007 |

* cited by examiner

*Primary Examiner*—Briggitte R Hammond
(74) *Attorney, Agent, or Firm*—Andrew C. Cheng; Wei Te Chung; Ming Chieh Chang

(57) ABSTRACT

An electrical connector comprises an housing receiving a plurality of terminals and a shell assembled on the housing. The shell defines a pair of soldering tails each comprising a horizontal portion extending from an upper wall of the shell, a crook portion extending from the horizontal portion upwardly and then downwardly, and an upright portion extending from the crook portion downwardly. The upward crook portion ensures the horizontal portion to abut against the surface of PCB completely.

11 Claims, 5 Drawing Sheets

ELECTRICAL CONNECTOR WITH A SHIELDING SHELL HAVING SOLDERING TAILS

BACKGROUND OF THE INVENTION

1. Field of the Invention

The present invention relates to an electrical connector, especially to an electrical connector having soldering tails soldered on a printed circuit board (PCB).

2. Description of the Related Art

Nowadays, more and more electrical connectors have made in a sunk-in-board type along with the miniature trend of the electronic products. A common sunk type connector comprises a metal shell, an insulative housing assembled within the shell and a plurality terminals received in the housing. The shell includes an upper wall and a pair of side walls extending from the two opposite sides of the upper wall. Each side wall defines a soldering tail thereon and the soldering tail comprises a holding portion bent outwards from the side wall and an inserting tail bent downwards from the end of the holding portion. The inserting tail is perpendicular to the PCB and the holding portion is parallel with the PCB, the holding portion covers on the PCB after the inserting tails are inserted into the holes through the PCB.

The soldering tail would form an arc chamfer at the intersection of the holding portion and the inserting tail while bending the inserting tail downwards from the holding portion. When the inserting tails are inserted into the aperture with a small dimension, the chamfer will easily interfere with the edge of the aperture and the holding portion will not abut against the PCB, thereby a distance forming between the holding portion and the PCB. Furthermore, the holding portion can't be manufactured completely flat currently so that the holding portion would not abut against the PCB too.

Hence, it is desirable to provide an improved electrical connector to overcome the aforementioned disadvantages.

SUMMARY OF THE INVENTION

Accordingly, the object of the present invention is to provide an electrical connector, which could be assembled on the PCB accurately.

In order to achieve the above-mentioned object, an electrical connector in accordance with the present invention comprises an insulative housing with a plurality of terminals received therein and a metal shell assembled on the housing. The shell defines at least one soldering tail which comprises a horizontal portion extending from the metal shell, an upright portion for being inserted into an aperture of a PCB where the electrical connector is mounted and a crook portion connecting with the horizontal portion and the upright portion, the crook portion being arranged away from the upright portion.

Other features and advantages of the present invention will become more apparent to those skilled in the art upon examination of the following drawings and detailed description of preferred embodiments.

DETAILED DESCRIPTION OF PREFERRED EMBODIMENT

Figure 1:
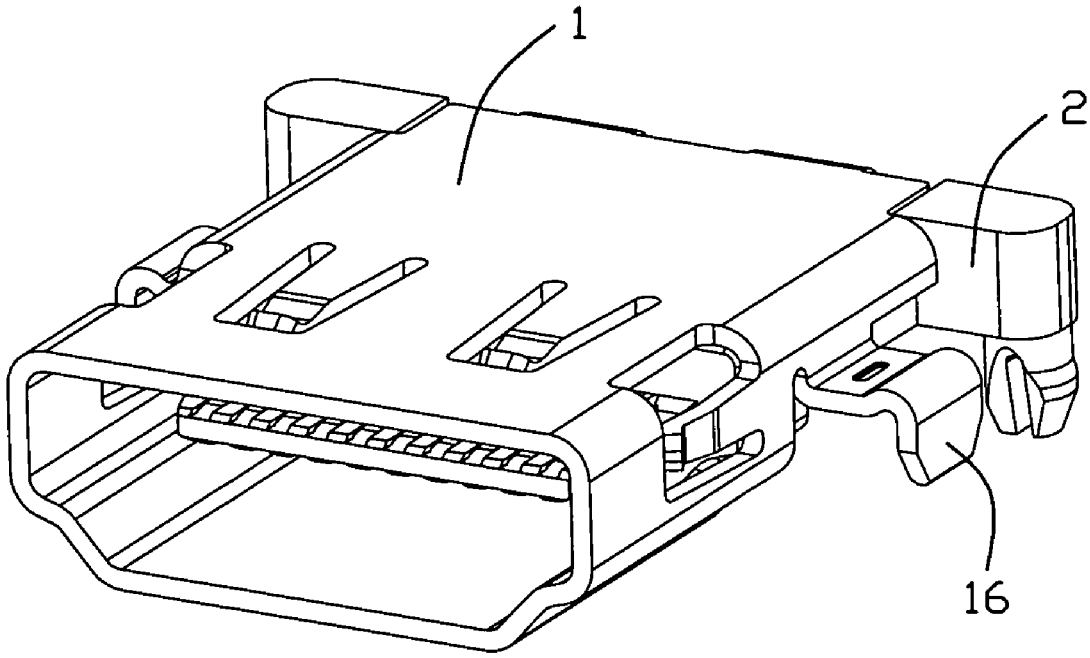
FIG. 1 is a perspective view according to a preferred embodiment of the present invention.

Reference will now be made to the drawing figures to describe the preferred embodiment of the present invention in detail.

Referring to FIGS. 1 to 4, an electrical connector in accordance with the present invention is a sunk type which comprises an insulative housing 2 with a plurality of terminals 3 assembled therein, a shell 1 covering the housing 2 and a position board 4.

Figure 3:
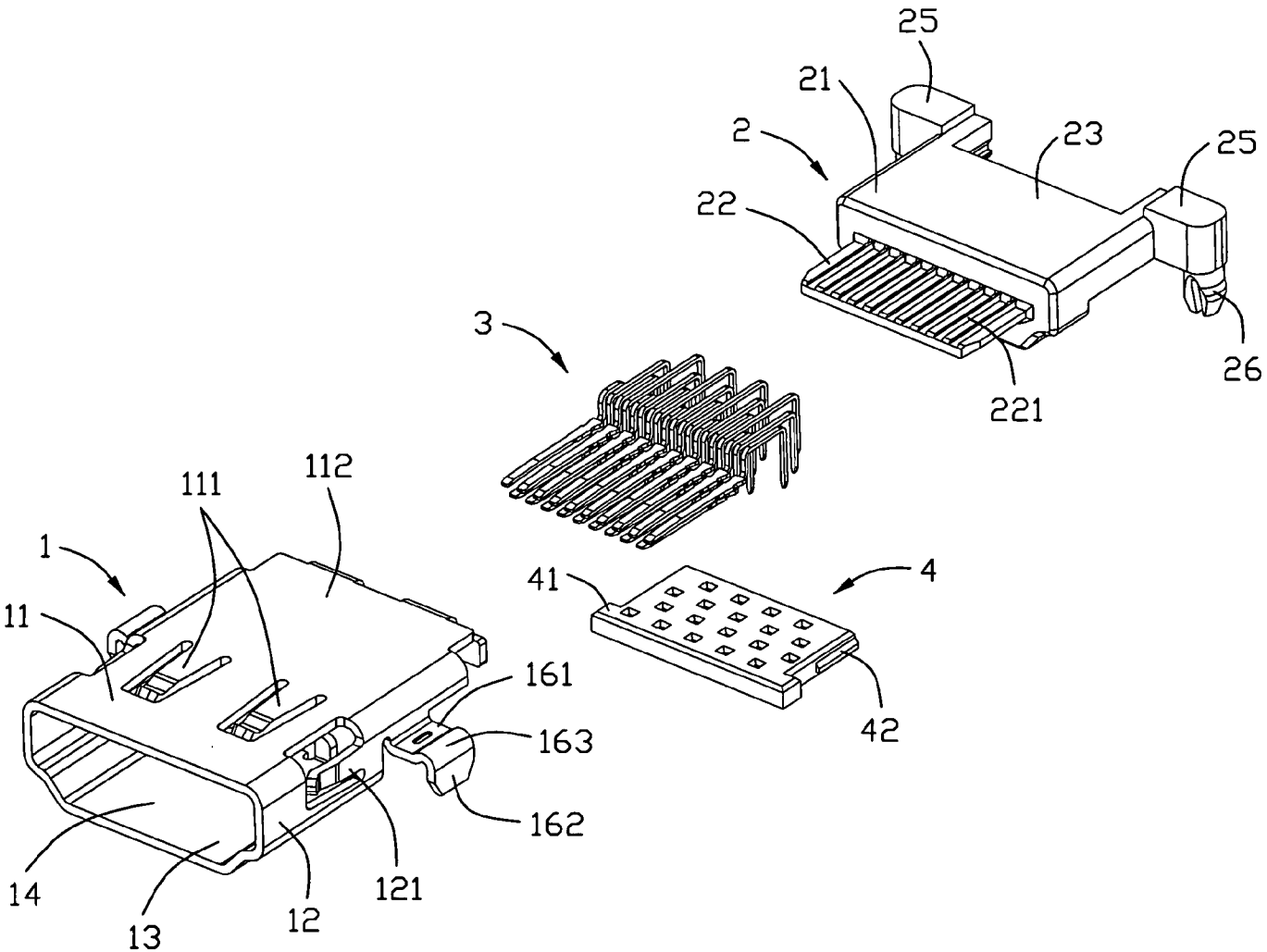
FIG. 3 is an exploded perspective view of the electrical connector of FIG. 1.
Figure 4:
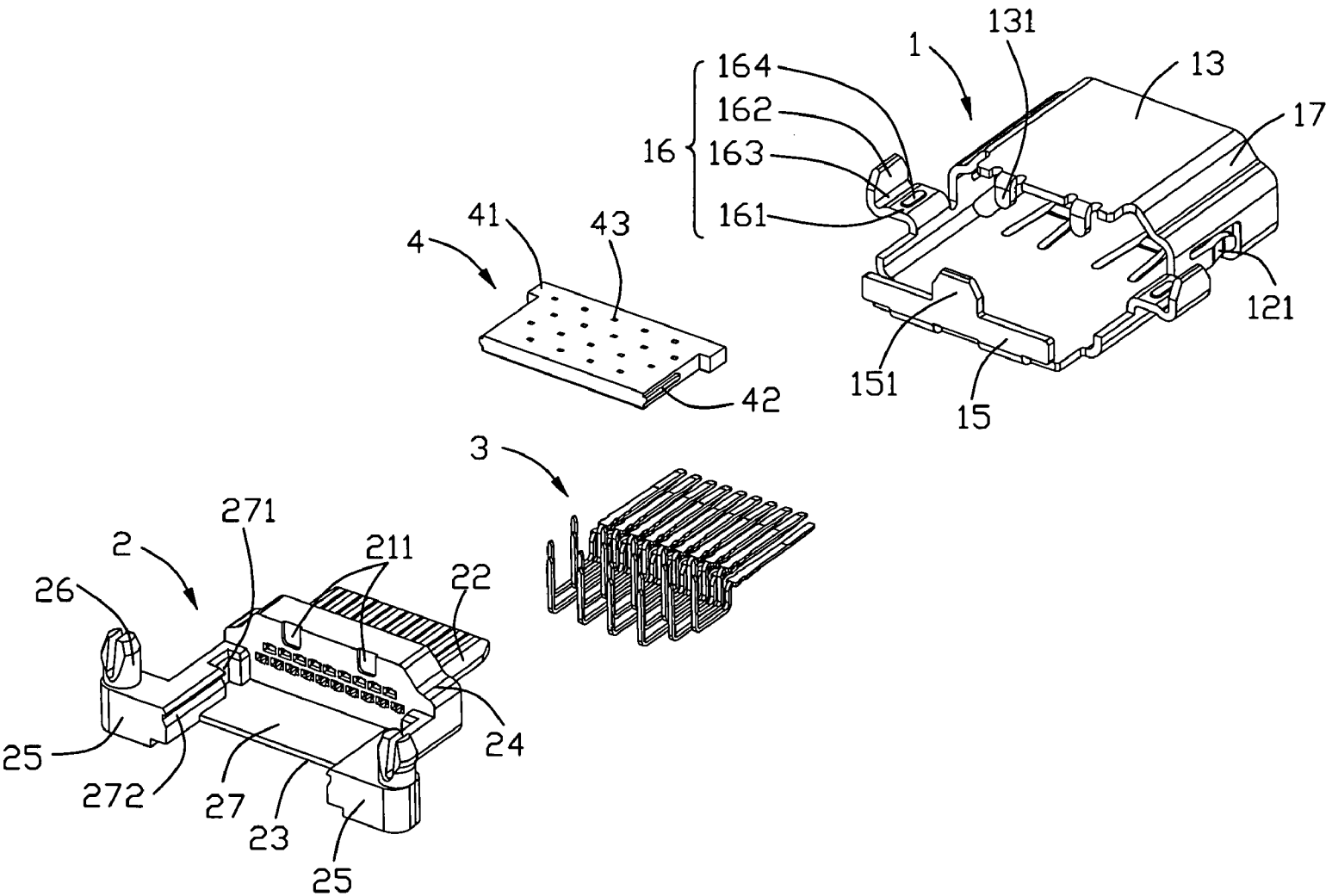
FIG. 4 is a view similar to FIG. 3, but taken from another perspective.

Referring to FIGS. 3 to 4, the shell 1 comprises an upper wall 11, a pair of side walls 12 perpendicularly extending downwards from two opposite lateral sides of the upper wall 11 respectively, a bottom wall 13 facing to the upper wall 11 and a receiving cavity 14 defined between said four walls. The upper wall 11 defines a pair of resilient sheets 111 forwards protruding to the cavity 14 adjacent to the front open of the cavity 14. The upper wall 11 is longer than the bottom wall 13 to defining an elongating portion 112 at an rear portion thereof. A back wall 15 folds downwards from the back end of the elongating portion 112. A soldering sheet 151 extends downwards from the center of the back wall 15 and is inserted into a hole defined in the PCB (not shown). The side walls 12 defines a resilient sheet 121 separately to fasten a mating connector stably. At the intersections of the sides wall 12 and the bottom wall 13 respectively defined a draped portion 17, a pair of symmetrical lock arms 131 are defined at the back end of bottom wall 13.

Figure 5:
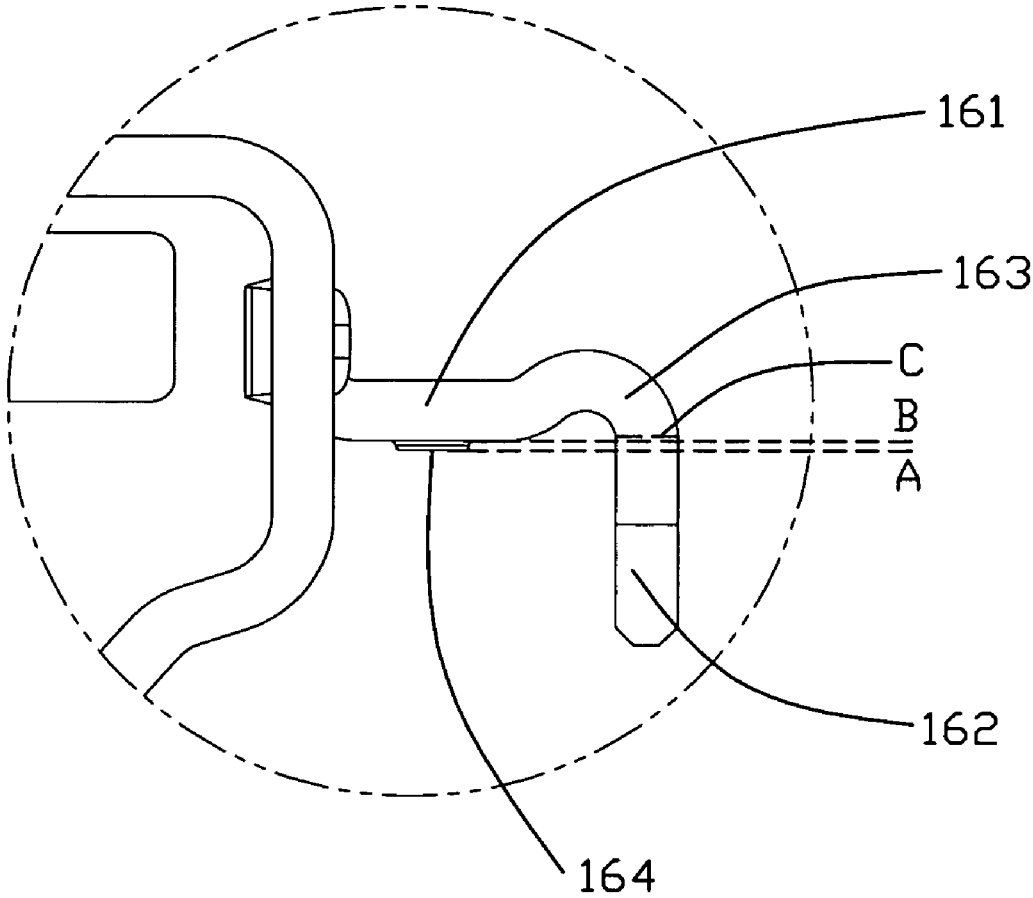
FIG. 5 is a partially magnify perspective view of the present invention.

At two opposite sides of elongating portion 112 of the upper wall 11, a pair of soldering tails 16 extending downwards are defined respectively. Each soldering tail 16 includes a horizontal portion 161 bending outwards from the elongating portion 112, an upright portion 162 and a crook portion 163 connecting with horizontal portion 161 and the upright portion 162. The crook portion 163 bends from the end of the horizontal portion 161 upwardly and then downwardly. The upright portion 162 is inserted into an aperture (not shown) of the PCB. The horizontal portion 161 is perpendicular to the upright portion 162 and has a protrusion 164 on its bottom face which faces to the PCB. As shown in FIG. 5, the crook portion 163 is in an arc shape and bends away from the upright portion 162. The horizontal portion 161 has a PCB-abutting plane as broken line B shown, which is used to abut against the PCB. The top of the upright portion 162, i.e. an intersection line (as broken line C shown) of the upright portion 162 and the crook portion 163 is above the PCB-abutting plane (broken line B) in a top view of the connector. Therefore, the crook portion 163 will not interference with the PCB when the soldering tail is inserted into the aperture of the PCB. Alternatively, the PCB-abutting plane of the horizontal portion is at a same lever with he top of the upright portion, which is a critical situation. The defined projection 164 will raise the horizontal portion 161 and the top of the upright portion 162 is more higher than a PCB-abutting plane as broken line A shown. Therefore, interfering possibility between the crook portion and PCB will greatly decrease.

Figure 2:
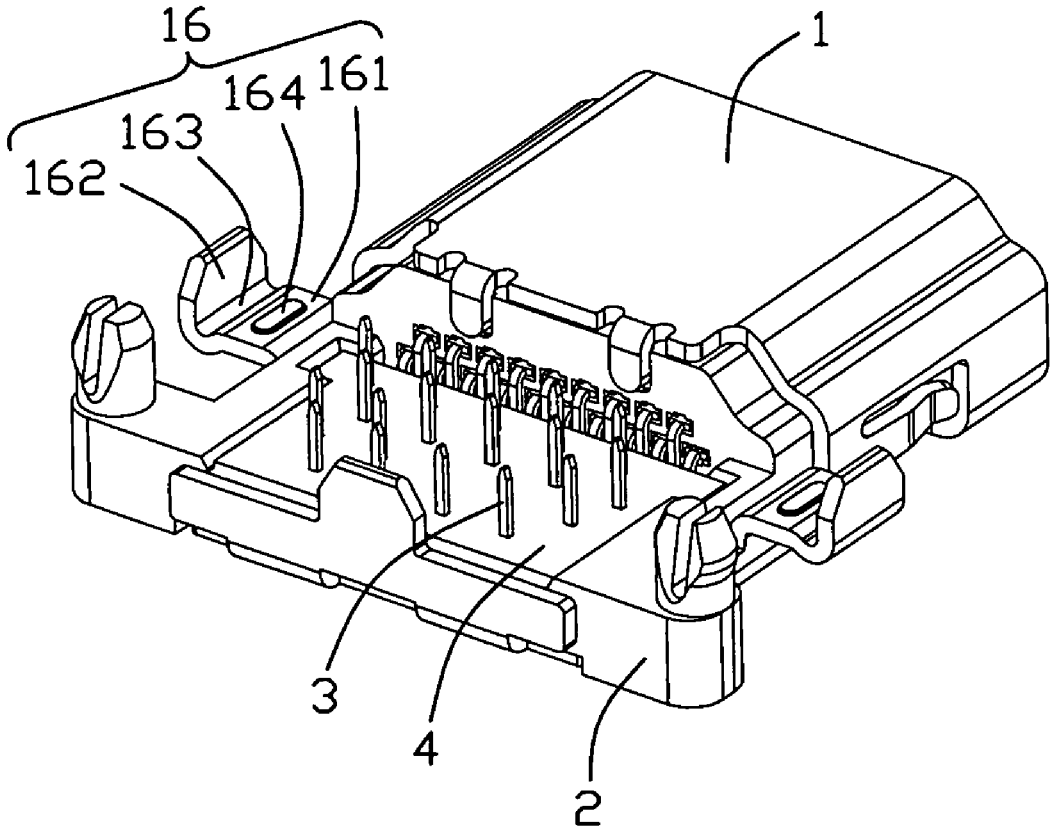
FIG. 2 is a perspective view similar to FIG. 1, taken from another view.

Referring to FIGS. 3 and 4, the housing 2 comprise a base portion 21, a mating portion 22 extending forwards from a front face of the base portion 21 and an outspread portion 23 extending backwards from a rear face of the base portion 21 relative to the elongating portion 112. The base portion 21 has a pair of transition portions 24 relative to the draped portion 17 at the intersection of two side faces and a bottom face of the base portion 21 separately and a pair of recesses 211 are defined on the rear face of the base portion 21 mating with the lock arms 131 correspondingly. The mating portion 22 defines a plurality of passageways 221 on its upper and bottom face passing through the front and rear face of the base portion 21. At the back end of the outspread portion 23, a pair of projections 25 extends outwards from the two opposite sides of outspread portion 23 separately, a position post 26 extends downwards from the projection 25 and a narrow slot in the center extends upwards from the bottom of the position post. The housing 2 has a depressed portion 27 between a bottom face of the outspread portion 23 and the rear face of the base portion 21. The position board 4 is received in the depressed portion 27. A pair of ribs 41 and tubers 42 defined on two opposite sides of the position board 4 are fastened in a pair of grooves 271 and slots 272 defined on the two opposite sides of the outspread portion 23 correspondingly. The terminals 3 pass through the rear face of the base portion 21 and are inserted into a plurality of holes 43 through the position board 4. The back wall 15 covers on the rear portion of the outspread portion 23 and the position board 4, as shown in FIG. 2.

The present invention could have other embodiment besides above-mentioned description, for instance, the soldering tail 16 could extending from the side wall 12 of shell 1 except from the upper wall 11.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

an insulative housing;

a plurality of terminals retained in the housing;

a metal shell assembled on the housing, defining at least one soldering tail, the soldering tail comprising a horizontal portion extending from the metal shell, an upright portion for being inserted into an aperture of a printed circuit board where the electrical connector is mounted and a crook portion connecting with the horizontal portion and the upright portion, the crook portion being arranged away from the upright portion and is arc shaped and bends upwards and then downwards from the horizontal portion.

2. The electrical connector of claim 1, wherein a protrusion is defined on a face of the horizontal portion facing the printed circuit board.

3. The electrical connector of claim 1, wherein an intersection of the upright portion and the crook portion is higher or equal to an intersection of the horizontal portion and the crook portion.

4. The electrical connector of claim 1, wherein the shell comprises an upper wall, a pair of side walls extending downwards from two opposite lateral sides of the upper wall and a bottom wall parallel with the upper wall, a draped portion is defined at an intersection of the side walls and the bottom wall separately.

5. The electrical connector of claim 4, wherein the housing comprises a base portion, a mating portion extending forwards from the base portion and an outspread portion extending backwards from the base portion, a position board is defined under the outspread portion for positioning the terminals.

6. The electrical connector of claim 5, wherein the position board has a pair of ribs and tubers at two opposite sides fastened in a pair of grooves and slots defined at two opposite sides of the outspread portion.

7. The electrical connector of claim 5, wherein a pair of position post with a slot extending upwards from the bottom side separately are defined at a back end of the housing.

8. The electrical connector of claim 5, wherein the upper wall of the shell has an elongating portion covering on the outspread portion, a back wall with at least one soldering sheet is defined at a back end of the outspread portion.

9. The electrical connector of claim 5, wherein at least one recess is defined on a rear face of the base portion, at least one lock arm extending backwards from the bottom wall of the shell is positioned in the recess correspondingly.

10. An electrical connector assembly comprising:

a printed circuit board defining a mounting surface with at least one through hole downwardly extending therethrough;

an electrical connector including:

an insulative housing;

a plurality of terminals disposed in the housing; and a metallic shell enclosing said housing and defining a horizontal portion extending around a mid-level of the connector for mounting to and an upright portion inserted into the through hole with a crooked portion connected therebetween; wherein an intersected line between the crooked portion and the upright portion is located above a bottom face of the horizontal portion so as to avoid interference between the crooked portion and the printed circuit board around the through hole.

11. The electrical connector assembly as claimed in claim 10, wherein a protrusion is formed on the bottom face of the horizontal portion to increase a distance between the intersected line and the printed circuit board around the through hole.

* * * * *